US009230536B2

(12) United States Patent
Otsuka et al.

(10) Patent No.: US 9,230,536 B2
(45) Date of Patent: Jan. 5, 2016

(54) VOICE SYNTHESIZER

(71) Applicant: Mitsubishi Electric Corporation, Chiyoda-ku (JP)

(72) Inventors: Takahiro Otsuka, Chiyoda-ku (JP); Keigo Kawashima, Chiyoda-ku (JP); Satoru Furuta, Chiyoda-ku (JP); Tadashi Yamaura, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 148 days.

(21) Appl. No.: 14/186,580

(22) Filed: Feb. 21, 2014

(65) Prior Publication Data

US 2015/0088520 A1 Mar. 26, 2015

(30) Foreign Application Priority Data

Sep. 25, 2013 (JP) ..... 2013-198252

(51) Int. Cl.
*G10L 13/00* (2006.01)
*G10L 13/06* (2013.01)

(52) U.S. Cl.
CPC ..... *G10L 13/06* (2013.01)

(58) Field of Classification Search
CPC ..... G10L 13/06; G10L 13/10; G10L 13/08; G10L 15/26; G10L 15/30
USPC ..... 704/235, 244, 252, 258, 260, 267, 268, 704/265, 269, 231, 239, 246, 263, 275, 704/E13.012, E15.044
See application file for complete search history.

(56) References Cited

U.S. PATENT DOCUMENTS

| | | | | |
|---|---|---|---|---|
| 5,758,320 | A * | 5/1998 | Asano | 704/258 |
| 7,243,069 | B2 * | 7/2007 | Jaepel et al. | 704/235 |
| 7,739,113 | B2 * | 6/2010 | Kaneyasu | 704/260 |
| 9,135,910 | B2 * | 9/2015 | Tamura et al. | 1/1 |

FOREIGN PATENT DOCUMENTS

| | | |
|---|---|---|
| CN | 103226945 A | 7/2013 |
| JP | 2004-233774 | 8/2004 |
| JP | 4167084 | 8/2008 |

OTHER PUBLICATIONS

Hiroya Takamura, "Natural language processing series 1 Introduction to machine learning for natural language processing", edited by Manabu Okumura, Corona Publishing, Chapter 5, Aug. 5, 2010, 5 pages.

Daniel Povey, et al., "Boosted MMI for Model and Feature-Space Discriminative Training", Acoustics, Speech and Signal Processing, 2008, ICASSP 2008, IEEE International Conference, 5 pages.

* cited by examiner

*Primary Examiner* — Charlotte M Baker
(74) *Attorney, Agent, or Firm* — Oblon, McClelland, Maier & Neustadt, L.L.P.

(57) ABSTRACT

A candidate voice segment sequence generator 1 generates candidate voice segment sequences 102 for an input language information sequence 101 by using DB voice segments 105 in a voice segment database 4. An output voice segment sequence determinator 2 calculates a degree of match between the input language information sequence 101 and each of the candidate voice segment sequences 102 by using a parameter 107 showing a value according to a cooccurrence criterion 106 for cooccurrence between the input language information sequence 101 and a sound parameter showing the attribute of each of a plurality of candidate voice segments in each of the candidate voice segment sequences 102, and determines an output voice segment sequence 103 on the basis of the degree of match.

6 Claims, 5 Drawing Sheets

| Input Language Information |
| --- |
| m/L |
| i/L |
| z/H |
| u/H |
| u/H |
| m/L |
| i/L |

FIG.3

| 301 Number | 302 DB Language Information | 303 Sound Parameter | 304 Waveform Segment |
|---|---|---|---|
| 1 | m/L | Amplitude In First Frequency Band At Left End Of Spectrum: 3<br>…<br>Amplitude In Tenth Frequency Band At Left End Of Spectrum: 5<br>Amplitude In First Frequency Band At Right End Of Spectrum: 7<br>…<br>Amplitude In Tenth Frequency Band At Right End Of Spectrum: 6 } 305<br>Temporal Change Of Amplitude In First Frequency Band At Left End Of Spectrum: -2<br>…<br>Temporal Change Of Amplitude In Tenth Frequency Band At Left End Of Spectrum: 3 } 306<br>Fundamental Frequency: 4 ~307<br>Duration: 5 ~308<br>Linguistic Environment: "*/*+*/*+i/L+z/H" ~309 | Sound Pressure Signal Sequence |
| 2 | i/L | Data Similar To Above-Mentioned Data | Data Similar To Above-Mentioned Data |
| 3 | z/H | Data Similar To Above-Mentioned Data | Data Similar To Above-Mentioned Data |
| 4 | u/H | Data Similar To Above-Mentioned Data | Data Similar To Above-Mentioned Data |
| 5 | k/L | Data Similar To Above-Mentioned Data | Data Similar To Above-Mentioned Data |
| 6 | i/L | Data Similar To Above-Mentioned Data | Data Similar To Above-Mentioned Data |
| 7 | z/H | Data Similar To Above-Mentioned Data | Data Similar To Above-Mentioned Data |
| 8 | e/H | Data Similar To Above-Mentioned Data | Data Similar To Above-Mentioned Data |
| … | … | … | … |

FIG.4

401 106 107

| Number | Cooccurrence Criteria | Parameter |
|---|---|---|
| 1 | Sound Height Of Current Input Language Information Is H, And Fundamental Frequency Of Current Voice Segment Is 7 | 10 |
| 2 | Sound Height Of Current Input Language Information Is H, And Fundamental Frequency Of Current Voice Segment Is 3 | -3 |
| 3 | Difference Between Fundamental Frequency Of Current Voice Segment And Fundamental Frequency Of First Preceding Voice Segment Is 0 | 8 |
| 4 | Difference Between Fundamental Frequency Of Current Voice Segment And Fundamental Frequency Of First Preceding Voice Segment Is 1 | 5 |
| 5 | Difference Between Fundamental Frequency Of Current Voice Segment And Fundamental Frequency Of First Preceding Voice Segment Is 0, Phoneme Of Current Input Language Information Is a, And Phoneme Of First Preceding Input Language Information Is m | -1 |
| 6 | Difference Between Fundamental Frequency Of Current Voice Segment And Fundamental Frequency Of First Preceding Voice Segment Is 1, Phoneme Of Current Input Language Information Is a, And Phoneme Of First Preceding Input Language Information Is m | 1 |
| 7 | Sound Height Of Current Input Language Information Is H, Fundamental Frequency Of Second Preceding Voice Segment Is 5, Fundamental Frequency Of First Preceding Voice Segment Is 6, And Fundamental Frequency Of Current Voice Segment Is 7 | 5 |
| 8 | Phoneme Of Current Input Language Information Is a, Amplitude In First Frequency Band At Right End Of Spectrum Of First Preceding Voice Segment Is 3, And Amplitude In First Frequency Band At Left End Of Spectrum Of Current Voice Segment Is 4 | 3 |
| 9 | Phoneme Of Current Input Language Information Is a, Amplitude In First Frequency Band At Right End Of Spectrum Of First Preceding Voice Segment Is 2, And Amplitude In First Frequency Band At Left End Of Spectrum Of Current Voice Segment Is 5 | -3 |
| 10 | Phoneme Of Current Input Language Information Is a, Phoneme Of First Preceding Input Language Information Is m, And Duration Of Current Voice Segment Is 9 | 4 |
| ... | ... | ... |

VOICE SYNTHESIZER

BACKGROUND OF THE INVENTION

1. Field of the Invention

The present invention relates to a voice synthesizer that synthesizes a voice from voice segments according to a time sequence of input language information.

2. Description of Related Art

There has been proposed a voice synthesis method based on a large-volume voice database, of using, as a measure, a statistical likelihood based on an HMM (Hidden Markov Model) used for voice recognition and so on, instead of a measure which is a combination of physical parameters determined on the basis of prospective knowledge, thereby providing an advantage of having rationality and homogeneity in voice quality on the basis of a probability measure of the synthesis method based on the HMM, together with an advantage of providing high quality because of the voice synthesis method based on a large-volume voice database and aimed at implementing a high-quality and homogeneous synthesized voice (for example, refer to patent reference 1).

According to the method disclosed by patent reference 1, by using both an acoustic model showing a probability of outputting an acoustic parameter (a linear predictor coefficient, a cepstrum, etc.) series for each state transition according to phoneme, and a rhythm model showing a probability of outputting a rhythm parameter (a fundamental frequency etc.) series for each state transition according to rhythm, a voice segment cost is calculated from the acoustical likelihood of the acoustic parameter series for each state transition corresponding to each phoneme which constructs a phoneme sequence for an input text, and the prosodic likelihood of the rhythm parameter series for each state transition corresponding to each rhythm which constructs a rhythm sequence for the input text, and voice segments are selected according to the voice segment costs.

RELATED ART DOCUMENT

Patent Reference

Patent reference 1: Japanese Unexamined Patent Application Publication No. 2004-233774

A problem with the conventional voice synthesis method mentioned above is, however, that it is difficult to determine how to determine "according to phoneme" for selection of voice segments, and therefore an appropriate acoustic model according to appropriate phoneme cannot be acquired and a probability of outputting the acoustic parameter series cannot be determined appropriately. Further, a problem is that like in the case of rhythms, it is difficult to determine how to determine "according to rhythm", and therefore an appropriate rhythm model according to appropriate rhythm cannot be acquired and a probability of outputting the rhythm parameter series cannot be determined appropriately.

Another problem is that because the probability of an acoustic parameter series is calculated by using an acoustic model according to phoneme in a conventional voice synthesis method, the acoustic model according to phoneme is not appropriate for an acoustic parameter series depending on a rhythm parameter series, and a probability of outputting the acoustic parameter series cannot be determined appropriately. Further, another problem is that like in the case of rhythms, because the probability of a rhythm parameter series is calculated by using a rhythm model according to rhythm in the conventional voice synthesis method, the rhythm model according to rhythm is not appropriate for a rhythm parameter series depending on an acoustic parameter series, and a probability of outputting the rhythm parameter series cannot be determined appropriately.

A further problem with a conventional voice synthesis method is that although a phoneme sequence (power for each phoneme, a phoneme length, and a fundamental frequency) corresponding to an input text is set up and an acoustic model storage for outputting an acoustic parameter series for each state transition according to phoneme is used, as mentioned in patent reference 1, an appropriate acoustic model cannot be selected if the accuracy of the setup of the phoneme sequence is low when such an acoustic model storage is used. A still further problem is that a setup of a phoneme sequence is needed and the operation becomes complicated.

A further problem with the conventional voice synthesis method is that a voice segment cost is calculated on the basis of a probability of outputting a sound parameter series, such as an acoustic parameter series or a rhythm parameter series, and therefore does not take into consideration the importance in terms of auditory sense of the sound parameter and voice segments acquired become unnatural auditorily.

SUMMARY OF THE INVENTION

The present invention is made in order to solve the above-mentioned problems, and it is therefore an object of the present invention to provide a voice synthesizer that can generate a high-quality synthesized voice.

In accordance with the present invention, there is provided a voice synthesizer including: a candidate voice segment sequence generator that generates candidate voice segment sequences for an inputted language information sequence which is an inputted time sequence of voice segments by referring to a voice segment database that stores time sequences of voice segments; an output voice segment determinator that calculates the degree of match between each of the candidate voice segment sequences and the input language information sequence by using a parameter showing a value according to a criterion for cooccurrence between the input language information sequence and a sound parameter showing an attribute of each of a plurality of candidate voice segments in the candidate voice segment sequence to determine an output voice segment sequence according to the degree of match; and a waveform segment connector that connects between the voice segments corresponding to the output voice segment sequence to generate a voice waveform.

Because the voice synthesizer in accordance with the present invention calculates the degree of match between each of the candidate voice segment sequences and the input language information sequence by using the parameter showing the value according to the criterion for cooccurrence between the input language information sequence and the sound parameter showing the attribute of each of the plurality of candidate voice segments in the candidate voice segment sequence to determine an output voice segment sequence according to the degree of match, the voice synthesizer can generate a high-quality synthesized voice.

Further objects and advantages of the present invention will be apparent from the following description of the preferred embodiments of the invention as illustrated in the accompanying drawings.

BRIEF DESCRIPTION OF THE DRAWINGS

FIG. 3 is an explanatory drawing showing a voice segment database of the voice synthesizer in accordance with any one of Embodiments 1 to 5 of the present invention;

FIG. 4 is an explanatory drawing showing a parameter dictionary of the voice synthesizer in accordance with any one of Embodiments 1 to 5 of the present invention;

DETAILED DESCRIPTION OF THE PREFERRED EMBODIMENTS

Figures 1, 2:
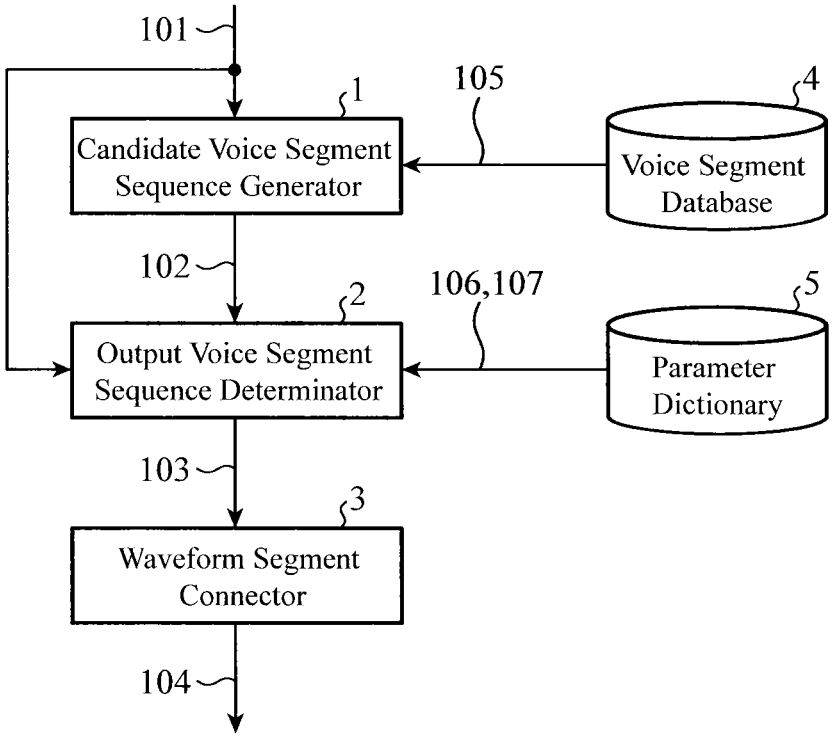
FIG. 1 is a block diagram showing a voice synthesizer in accordance with any one of Embodiments 1 to 5 of the present invention.
FIG. 2 is an explanatory drawing showing an inputted language information sequence inputted to the voice synthesizer in accordance with any one of Embodiments 1 to 5 of the present invention.

The preferred embodiments of the present invention will be now described with reference to the accompanying drawings. In the following description of the preferred embodiments, like reference numerals refer to like elements in the various views. Embodiment 1.

FIG. 1 is a block diagram showing a voice synthesizer in accordance with Embodiment 1 of the present invention. The voice synthesizer shown in FIG. 1 includes a candidate voice segment sequence generator 1, an output voice segment sequence determinator 2, a waveform segment connector 3, a voice segment database 4, and a parameter dictionary 5. The candidate voice segment sequence generator 1 combines an input language information sequence 101, which is inputted to the voice synthesizer, and DB voice segments 105 in the voice segment database 4 to generate candidate voice segment sequences 102. The output voice segment sequence determinator 2 refers to the input language information sequence 101, a candidate voice segment sequence 102, and the parameter dictionary 5 to generate an output voice segment sequence 103. The waveform segment connector 3 refers to the output voice segment sequence 103 to generate a voice waveform 104 which is an output of the voice synthesizer 6.

The input language information sequence 101 is a time sequence of pieces of input language information. Each piece of input language information consists of symbols showing the descriptions in a language of a voice waveform to be generated, such as a phoneme and a sound height. An example of the input language information sequence is shown in FIG. 2. This example is an input language information sequence showing a voice waveform "湖 (lake)" (みずうみ (mizuumi)) to be generated, and is a time sequence of seven pieces of input language information. For example, the first input language information shows that the phoneme ism and the sound height is L, and the third input language information shows that the phoneme is z and the sound height is H. In this example, m is a symbol showing the consonant of "み (mi)" which is the first syllable of "湖 (mizuumi)." The sound height L is a symbol showing that the sound level is low, and the sound height H is a symbol showing that the sound level is high. The input language information sequence 101 can be generated by a person, or can be generated mechanically by performing an automatic analysis on a text showing the descriptions in a language of a voice waveform to be generated by using a conventional typical language analysis technique.

The voice segment database 4 stores DB voice segment sequences. Each DB voice segment sequence is a time sequence of DB voice segments 105. Each DB voice segment 105 consists of a waveform segment, DB language information, and sound parameters. The waveform segment is a sound pressure signal sequence. The sound pressure signal sequence is a fragment of a time sequence of a signal regarding a sound pressure which is acquired by recording a voice uttered by a narrator or the like by using a microphone or the like. A form of recording a waveform segment can be a form in which the data volume is compressed by using a conventional typical signal compression technique. The DB language information is symbols showing the waveform segment, and consists of a phoneme, a sound height, etc. The phoneme is a phonemic symbol or the like showing the sound type (reading) of the waveform segment. The sound height is a symbol showing the sound level of the waveform segment, such as H (high) or L (low). The sound parameters consist of information, such as a spectrum, a fundamental frequency, and a duration, acquired by analyzing the waveform segment, and a linguistic environment, and are information showing the attribute of each voice segment.

The spectrum is values showing the amplitude and phase of a signal in each frequency band of the sound pressure signal sequence which are acquired by performing a frequency analysis on the sound pressure signal sequence. The fundamental frequency is the vibration frequency of the vocal cord which is acquired by analyzing the sound pressure signal sequence. The duration is the time length of the sound pressure signal sequence. The linguistic environment is symbols which consist of a plurality of pieces of DB language information including pieces of DB language information preceding to current DB language information and pieces of DB language information following the current DB language information. Concretely, the linguistic environment consists of DB language information secondly preceding the current DB language information, DB language information first preceding the current DB language information, DB language information first following the current DB language information, and DB language information secondly following the current DB language information. When the current DB language information is the top or end of a voice, each of the first preceding DB language information and the first following DB language information is expressed by a symbol such as an asterisk (*). The sound parameters can include, in addition to the above-mentioned quantities, a conventional feature quantity used for selection of voice segments, such as a feature quantity showing a temporal change in the spectrum or an MFCC (Mel Frequency Cepstral Coefficient).

An example of the voice segment database 4 is shown in FIG. 3. This voice segment database 4 stores time sequences of DB voice segments 105 each of which is comprised of a number 301, DB language information 302, sound parameters 303, and a waveform segment 304. The number 301 is added in order to make each DB voice segment easy to be identified. The sound pressure signal sequence of the waveform segment 304 is a fragment of a time sequence of a signal regarding a sound pressure which is acquired by recording a first voice "みず (mizu)", a second voice "きぜ (kize) . . . ", and . . . which are uttered by a narrator by using a microphone or the like. The sound pressure signal sequence whose number 301 is 1 is a fragment corresponding to the head of the first voice "みず (mizu)." The DB language information 302 shows a phoneme and a sound height which sandwich a slash between them. The phonemes of the time sequences are m, i, z, u, k, i, z, e, and . . . , and the sound heights of the time sequences are L, L, H, H, L, L, H, H, and . . . in the example.

For example, the phoneme m whose number 301 is 1 is a symbol showing the type (reading) of voice corresponding to the consonant of "み (mi)" of the first voice "みず (mizu)", and the sound height L whose number 301 is 1 is a symbol showing a sound level corresponding to the consonant of "mi" of the first voice "みず (mizu)."

In the example, the sound parameters 303 consist of spectral parameters 305, temporal changes in spectrum 306, a fundamental frequency 307, a duration 308, and a linguistic environment 309. The spectral parameters 305 consist of amplitude values in ten frequency bands each of which is quantized to one of ten levels ranging from 1 to 10 for each of signals at a left end (forward end with respect to time) and at a right end (backward end with respect to time) of the sound pressure signal sequence. The temporal changes in spectrum 306 consist of temporal changes in the amplitude values in the ten frequency bands each of which is quantized to one of 21 levels ranging from −10 to 10 in the fragment at the left end (forward end with respect to time) of the sound pressure signal sequence. Further, the fundamental frequency 307 is expressed by a value quantized to one of ten levels ranging from 1 to 10 for a voiced sound, and is expressed by 0 for a voiceless sound. Further, the duration 308 is expressed by a value quantized to one of ten levels ranging from 1 to 10. Although the number of levels in the quantization is 10 in the above-mentioned example, the number of levels in the quantization can be a different number according to the scale of the voice synthesizer, etc. Further, the linguistic environment 309 in the sound parameters 303 of number 1 is "*/**/*i/Lz/H", and FIG. 3 shows that the linguistic environment consists of DB language information (*/*) secondly preceding the current DB language information (m/L), DB language information (*/*) first preceding the current DB language information (m/L), DB language information (i/L) first following the current DB language information (m/L), and DB language information (z/H) secondly following the current DB language information (m/L).

The parameter dictionary 5 is a unit that stores pairs of cooccurrence criteria 106 and a parameter 107. The cooccurrence criteria 106 is a criterion by which to determine whether the input language information sequence 101 and the sound parameters 303 of a plurality of candidate voice segments of a candidate voice segment sequence 102 have specific values or symbols. The parameter 107 is a value which is referred to according to the cooccurrence criteria 106 in order to calculate the degree of match between the input language information sequence and the candidate voice segment sequence.

In this case, the plurality of candidate voice segments indicate a current candidate voice segment, a candidate voice segment first preceding (or secondly preceding) the current candidate voice segment, and a candidate voice segment first following (or secondly following) the current candidate voice segment in the candidate voice segment sequence 102.

The cooccurrence criteria 106 can also include a criterion that the results of computation, such as the difference among the sound parameters 303 of the plurality of candidate voice segments in the candidate voice segment sequence 102, the absolute value of the difference, a distance among them, and a correlation value among them, are specific values. The parameter 107 is a value which is set according to whether or not the combination (cooccurrence) of the input language information and the sound parameters 303 of the plurality of candidate voice segments is preferable. When the combination is preferable, the parameter is set to a large value; otherwise, the parameter is set to a small value (negative value).

An example of the parameter dictionary 5 is shown in FIG. 4. The parameter dictionary 5 is a unit that stores sets of a number 401, cooccurrence criteria 106, and a parameter 107. The number 401 is added in order to make the cooccurrence criteria 106 easy to be identified. The cooccurrence criteria 106 and the parameter 107 can show a relationship in preferability among the input language information sequence 101, a series of rhythm parameters, such as a fundamental frequency 307, a series of acoustic parameters, such as spectral parameters 305, and so on in detail. Examples of the cooccurrence criteria 106 are shown in FIG. 4. Because the fundamental frequency 307 in the sound parameters 303 of the current candidate voice segment has a useful (preferable or unpreferable) relationship with the sound height of the current input language information sequence 101, criteria regarding both the fundamental frequency 307 in the sound parameters 303 of the current candidate voice segment and the sound height of the current input language information (e.g., the cooccurrence criteria 106 of numbers 1 and 2 of FIG. 4) are described.

Because the difference between the fundamental frequency 307 of the current candidate voice segment and that of the first preceding candidate voice segment does not have a useful relationship with the current input language information fundamentally, only a criterion regarding the difference between the fundamental frequency of the current candidate voice segment and that of the first preceding candidate voice segment (e.g., the cooccurrence criteria 106 of numbers 3 and 4 of FIG. 4) is described. However, because the difference between the fundamental frequency 307 of the current candidate voice segment and that of the first preceding candidate voice segment has a useful relationship with a specific phoneme in the current input language information and a specific phoneme in the first preceding input language information, criteria regarding the difference between the fundamental frequency 307 of the current candidate voice segment and that of the first preceding candidate voice segment, the specific phoneme in the current input language information, and the specific phoneme in the first preceding input language information (e.g., the cooccurrence criteria 106 of numbers 5 and 6 of FIG. 4) are described. Because the fundamental frequency 307 in the sound parameters 303 of the current candidate voice segment has a useful relationship with the sound height of the current input language information, the fundamental frequency 307 in the sound parameters 303 of the first preceding candidate voice segment, and the fundamental frequency 307 in the sound parameters 303 of the second preceding candidate voice segment, cooccurrence criteria 106 regarding these parameters (e.g., the cooccurrence criteria 106 of number 7 of FIG. 4) are described.

Because the amplitude in the first frequency band at the left end of the spectrum in the sound parameters 303 of the current candidate voice segment has a useful relationship with the phoneme of the current input language information and the amplitude in the first frequency band at the right end of the spectrum in the sound parameters 303 of the first preceding candidate voice segment, cooccurrence criteria 106 regarding these parameters (e.g., the cooccurrence criteria 106 of numbers 8 and 9 of FIG. 4) are described. Because the duration 308 in the sound parameters 303 of the current DB voice segment has a useful relationship with the phoneme of the current input language information sequence and the phoneme of the first preceding input language information sequence, cooccurrence criteria 106 regarding these parameters (e.g., the cooccurrence criteria 106 of number 10 of FIG. 4) are described. Although cooccurrence criteria 106 are provided when there is a useful relationship in the above-mentioned example, the present embodiment is not limited to this example. Also when there is no useful relationship, cooccurrence criteria 106 can be provided. In this case, the parameter is set to 0.

Figure 5:
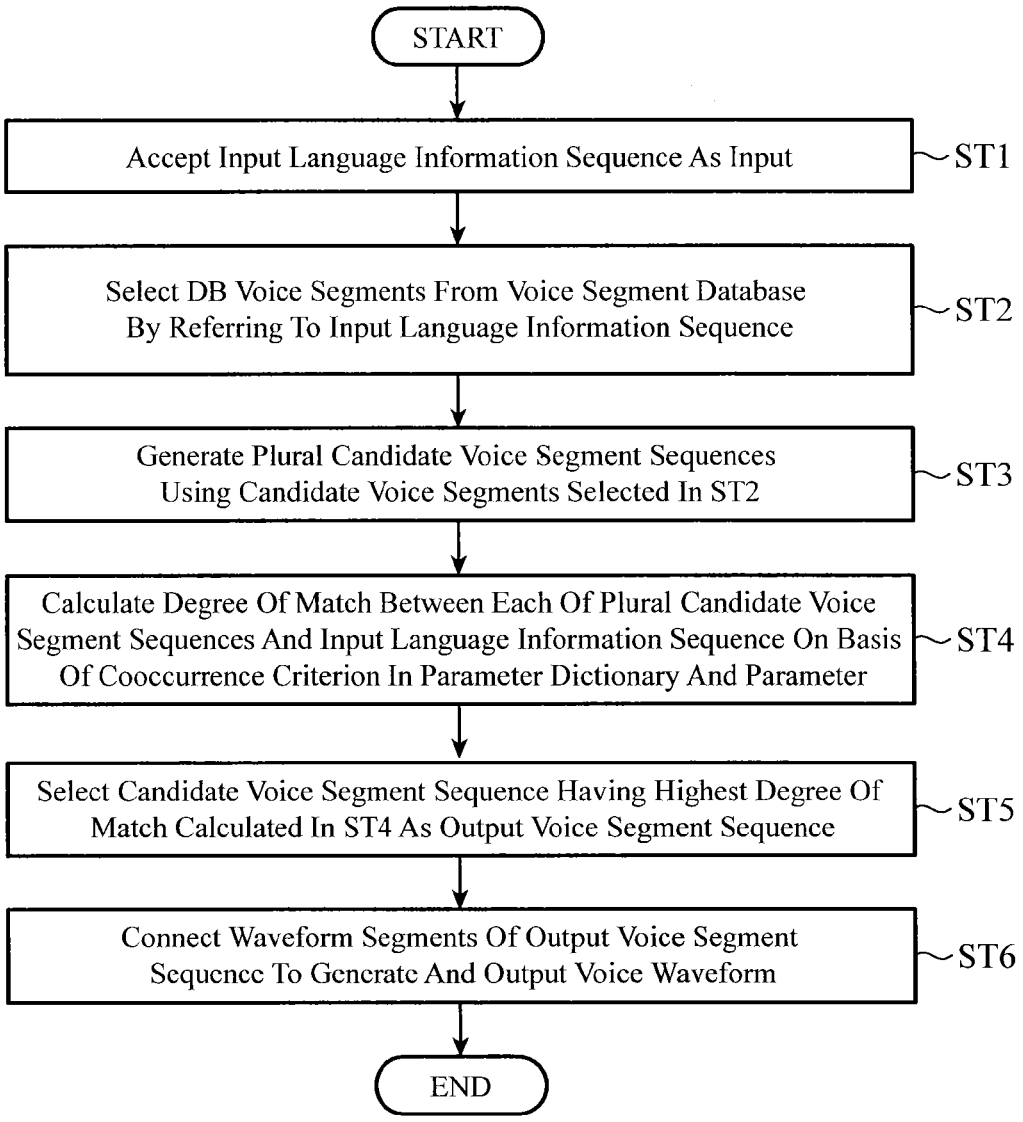
FIG. 5 is a flow chart showing the operation of the voice synthesizer in accordance with any one of Embodiments 1 to 5 of the present invention.

Next, the operation of the voice synthesizer in accordance with Embodiment 1 will be explained. FIG. 5 is a flow chart showing the operation of the voice synthesizer in accordance with Embodiment 1.

<Step ST1>

In step ST1, the candidate voice segment sequence generator 1 accepts an input language information sequence 101 as an input to the voice synthesizer.

<Step ST2>

In step ST2, the candidate voice segment sequence generator 1 refers to the input language information sequence 101 to select DB voice segments 105 from the voice segment database 4, and sets these DB voice segments as candidate voice segments. Concretely, as to each of pieces of input language information, the candidate voice segment sequence generator 1 selects a DB voice segment 105 whose DB language information 302 matches the input language information, and sets this DB voice segment as a candidate voice segment. For example, DB language information 302 shown in FIG. 3 which matches the first input language information in the input language information sequence shown in FIG. 2 is the one of a DB voice segment of number 1. The DB voice segment of number 1 has a phoneme of m and a sound height of L, and these phoneme and sound height match the phoneme m and the sound height L of the first input language information shown in FIG. 2 respectively.

<Step ST3>

In step ST3, the candidate voice segment sequence generator 1 generates candidate voice segment sequences 102 by using the candidate voice segments acquired in step ST2. A plurality of candidate voice segments are usually selected for each of the pieces of input language information, and all combinations of these candidate voice segments are provided as a plurality of candidate voice segment sequences 102. When the number of candidate voice segments selected for each of the pieces of input language information is one, only one candidate voice segment sequence 102 is provided. In this case, subsequent processes (steps ST3 to ST5) can be omitted, the candidate voice segment sequence 102 can be set as an output voice segment sequence 103, and the voice synthesizer can shift its operation to step ST6.

Figure 6:
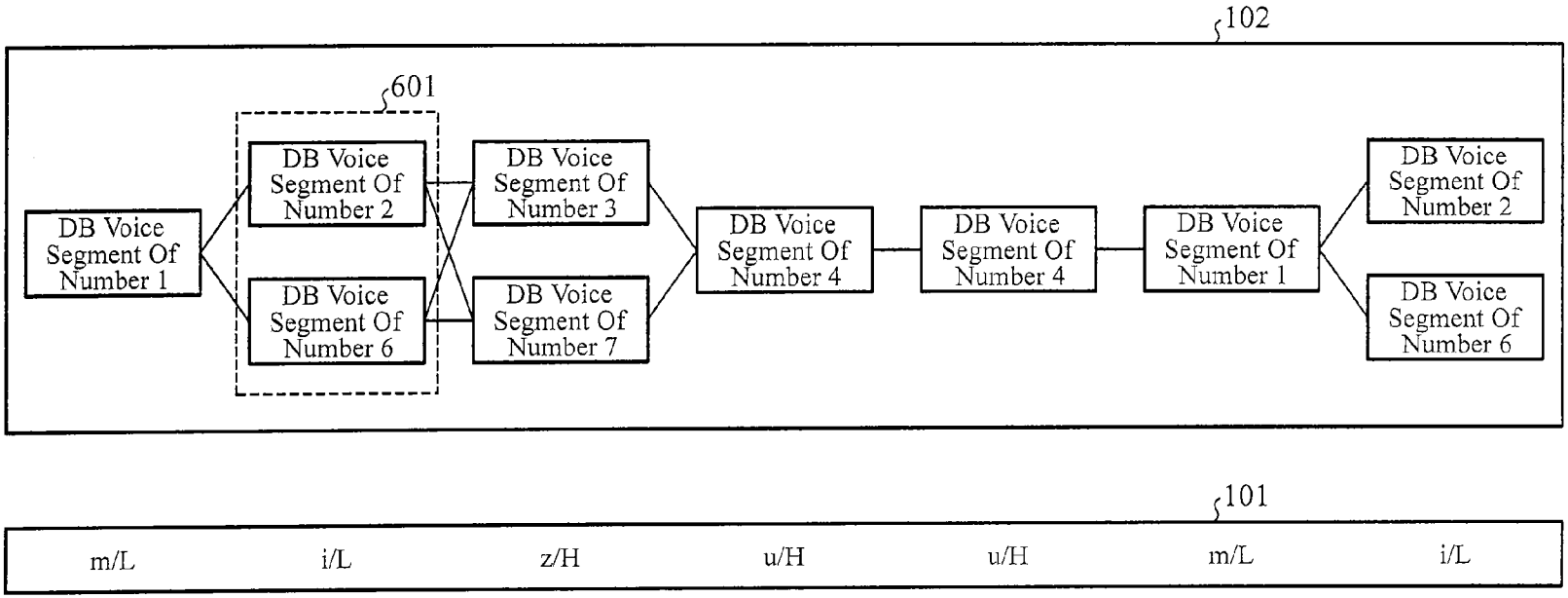
FIG. 6 is an explanatory drawing showing an example of the inputted language information sequence and a candidate voice segment sequence in the voice synthesizer in accordance with Embodiment 1 of the present invention.

In FIG. 6, an example of the candidate voice segment sequences 102 and an example of the input language information sequence 101 are shown while they are brought into correspondence with each other. The candidate voice segment sequences 102 shown in this figure are the plurality of candidate voice segment sequences which are generated, in step ST3, by selecting DB voice segments 105 from the voice segment database 4 shown in FIG. 3 with reference to the input language information sequence 101. The input language information sequence 101 is the time sequence of pieces of input language information as shown in FIG. 2.

In this example, each box shown by a solid line rectangular frame in the candidate voice segment sequences 102 shows one candidate voice segment and each line connecting between boxes shows a combination of candidate voice segments. The figure shows that eight possible candidate voice segment sequences 102 are acquired in the example. Further, the figure shows that second candidate voice segments 601 corresponding to the second input language information (i/L) are a DB voice segment of number 2 and a DB voice segment of number 6.

<Step ST4>

In step ST4, the output sound element sequence determinator 2 calculates the degree of match between each of the candidate voice segment sequences 102 and the input language information sequence on the basis of cooccurrence criteria 106 and parameters 107. A method of calculating the degree of match will be described in detail by taking, as an example, a case in which cooccurrence criteria 106 are described as to the second preceding candidate voice segment, the first preceding candidate voice segment, and the current candidate voice segment. The output sound element sequence determinator refers to the (s−2)-th input language information, the (s−1)-th input language information, the s-th input language information, and the sound parameters 303 of the candidate voice segments corresponding to these pieces of input language information to search for applicable cooccurrence criteria 106 from the parameter dictionary 5, and sets a value which is acquired by adding the parameters 107 corresponding to all the applicable cooccurrence criteria 106 as a parameter additional value. In this case, "s-th" is a variable showing a time position of each piece of input language information in the input language information sequence 101, and so on.

At this time, the "second preceding input language information" in cooccurrence criteria 106 corresponds to the (s−2)-th input language information, the "first preceding input language information" in cooccurrence criteria 106 corresponds to the (s−1)-th input language information, and the "current input language information" in cooccurrence criteria 106 corresponds to the s-th input language information. At this time, the "second preceding voice segment" in cooccurrence criteria 106 corresponds to the candidate voice segment corresponding to the input language information of number (s−2), the "first preceding voice segment" in cooccurrence criteria 106 corresponds to the candidate voice segment corresponding to the input language information of number (s−1), and the "current voice segment" in cooccurrence criteria 106 corresponds to the DB voice segment corresponding to the input language information of number s. The degree of match is a parameter additional value acquired by changing s from 3 to the number of pieces of input language information in the input language information sequence to repeatedly carry out the same process as that mentioned above. s can be changed from 1, and, in this case, the sound parameters 303 of voice segments corresponding the input language information of number 0 and the input language information of number −1 are set to fixed values predetermined.

The above-mentioned process is repeatedly carried out on each of the candidate voice segment sequences 102 to determine the degree of match between each of the candidate voice segment sequences 102 and the input language information sequence. The calculation of the degree of match is shown by taking, as an example, the candidate voice segment sequence 102 shown below among the plurality of candidate voice segment sequences 102 shown in FIG. 6.

The first input language information: the first candidate voice segment is the DB voice segment of number 1.

The second input language information: the second candidate voice segment is the DB voice segment of number 2.

The third input language information: the third candidate voice segment is the DB voice segment of number 3.

The fourth input language information: the fourth candidate voice segment is the DB voice segment of number 4.

The fifth input language information: the fifth candidate voice segment is the DB voice segment of number 4.

The sixth input language information: the sixth candidate voice segment is the DB voice segment of number 1.

The seventh input language information: the seventh candidate voice segment is the DB voice segment of number 2.

The first input language information, the second input language information, and the third input language information, and the sound parameters 303 of the DB voice segments of number 1, number 2, and number 3 are referred to first, the applicable cooccurrence criteria 106 are searched for from the parameter dictionary 5 shown in FIG. 4, and a value which is acquired by adding the parameters 107 corresponding to all the applicable cooccurrence criteria 106 is set as a parameter additional value. At this time, the "second preceding input language information" in the cooccurrence criteria 106 corresponds to the first input language information (m/L), the "first preceding input language information" in the cooccurrence criteria 106 corresponds to the second input language information (i/L), and the "current input language information" in the cooccurrence criteria 106 corresponds to the third input language information (z/H). Further, at this time, the "second preceding voice segment" in the cooccurrence criteria 106 corresponds to the DB voice segment of number 1, the "first preceding voice segment" in the cooccurrence criteria 106 corresponds to the DB voice segment of number 2, and the "current voice segment" in the cooccurrence criteria 106 corresponds to the DB voice segment of number 3.

Next, the second input language information, the third input language information, and the fourth input language information, and the sound parameters 303 of the DB voice segments of number 2, number 3, and number 4 are referred to first, the applicable cooccurrence criteria 106 are searched for from the parameter dictionary 5 shown in FIG. 4, and the parameters 107 corresponding to all the applicable cooccurrence criteria 106 are added to the parameter additional value mentioned above. At this time, the "second preceding input language information" in the cooccurrence criteria 106 corresponds to the second input language information (i/L), the "first preceding input language information" in the cooccurrence criteria 106 corresponds to the third input language information (z/H), and the "current input language information" in the cooccurrence criteria 106 corresponds to the fourth input language information (u/H). Further, at this time, the "second preceding voice segment" in the cooccurrence criteria 106 corresponds to the DB voice segment of number 2, the "first preceding voice segment" in the cooccurrence criteria 106 corresponds to the DB voice segment of number 3, and the "current voice segment" in the cooccurrence criteria 106 corresponds to the DB voice segment of number 4. The parameter additional value which is acquired by repeatedly carrying out the same process as the above-mentioned process on up to the last sequence of the fifth input language information, the sixth input language information, and the seventh input language information, and the DB voice segments of number 4, number 1, and number 2 is set as the degree of match.

<Step ST5>

In step ST5, the output voice segment sequence determinator 2 selects the candidate voice segment sequence 102 whose degree of match calculated in step ST4 is the highest one among those of the plurality of candidate voice segment sequences 102 as the output voice segment sequence 103. More specifically, the DB voice segments which construct the candidate voice segment sequence 102 having the highest degree of match are defined as output voice segments, and a time sequence of these DB voice segments is defined as the output voice segment sequence 103.

<Step ST6>

In step ST6, the waveform segment connector 3 connects the waveform segments 304 of the output voice segments in the output voice segment sequence 103 in order to generate a voice waveform 104 and outputs the generated voice waveform 104 from the voice synthesizer. The connection of the waveform segments 304 should just be carried out by using, for example, a known technique of connecting the right end of the sound pressure signal sequence of a first preceding output voice segment and the left end of the sound pressure signal sequence of the output voice segment following the first preceding output voice segment in such a way that they are in phase with each other.

As previously explained, because the voice synthesizer in accordance with Embodiment 1 includes: the candidate voice segment sequence generator that generates candidate voice segment sequences for an input language information sequence which is an inputted time sequence of voice segments by referring to a voice segment database that stores time sequences of voice segments; the output voice segment determinator that calculates the degree of match between each of the candidate voice segment sequences and the input language information sequence by using a parameter showing a value according to a criterion for cooccurrence between the input language information sequence and a sound parameter showing the attribute of each of a plurality of candidate voice segments in the candidate voice segment sequence to determine an output voice segment sequence according to the degree of match; and the waveform segment connector that connects the voice segments corresponding to the output voice segment sequence to generate a voice waveform, there is provided an advantage of eliminating the necessity to prepare an acoustic model according to phoneme and a rhythm model according to rhythm, thereby being able to avoid a problem arising in a conventional method of determining "according to phoneme" and "according to rhythm".

There is provided another advantage of being able to set a parameter which takes into consideration a relationship among phonemes, amplitude spectra, fundamental frequencies, and so on, and to calculate an appropriate degree of match. There is provided a further advantage of eliminating the necessity to prepare an acoustic model according to phoneme, eliminating the necessity to set up a phoneme sequence which is information for distributing according to phoneme, and being able to simplify the operation of the device.

Further, because in the voice synthesizer in accordance with Embodiment 1 each cooccurrence criteria are the ones that the results of computation of the values of the sound parameters of each of a plurality of candidate voice segments in a candidate voice segment sequence are specific values, the difference among the sound parameters of a plurality of candidate voice segments, such as a second preceding voice segment, a first preceding voice segment, and a current voice segment, the absolute value of the difference, a distance among them, and a correlation value among them can be set as cooccurrence criteria, there is provided a still further advantage of being able to set up cooccurrence criteria and parameters which take into consideration the difference, the distance, the correlation, and so on regarding the relationship among the sound parameters, and to calculate an appropriate degree of match.

Embodiment 2

Although the parameter 107 is set to a value depending upon the preferability of the combination of the input language information sequence 101 and the sound parameters 303 of each candidate voice segment sequence 102 in Embodiment 1, the parameter 107 can be alternatively set as follows. More specifically, the parameter 107 is set to a large value in a case of a candidate voice segment sequence 102 which is the same as a DB voice segment sequence among a plurality of candidate voice segment sequences 102 corresponding to a sequence of pieces of DB language information 302 of the DB voice segment sequence. As an alternative, the parameter 107 is set to a small value in a case of a candidate voice segment sequence 102 different from the DB voice segment sequence. The parameter 107 can be alternatively set to both the values.

Next, a method of setting the parameter 107 in accordance with Embodiment 2 will be explained. A candidate voice segment sequence generator 1 assumes that a sequence of pieces of DB language information in a voice segment database 4 is an input language information sequence 101, and generates a plurality of candidate voice segment sequences 102 corresponding to this input language information sequence 101. An output voice segment sequence determinator then determines a frequency A to which each cooccurrence criterion 106 is applied in a candidate voice segment sequence 102, among the plurality of candidate voice segment sequences 102, which is the same as the DB voice segment sequence. Next, the output voice segment sequence determinator determines a frequency B to which each cooccurrence criterion 106 is applied in a candidate voice segment sequence 102, among the plurality of candidate voice segment sequences 102, which is different from the DB voice segment sequence. The candidate voice segment sequence generator then sets the parameter 107 of each cooccurrence criterion 106 to the difference between the frequency A and the frequency B (frequency A-frequency B).

As explained above, the candidate voice segment sequence generator assumes that a time sequence of voice segments in the voice segment database is an input language information sequence, and generates a plurality of candidate voice segment sequences corresponding to the time sequence which is assumed to be the input language information sequence, and the output voice segment sequence determinator sets the parameter to a large value for a candidate voice segment sequence, among the plurality of generated candidate voice segment sequences, which is the same as the time sequence which is assumed to be the input language information sequence, or sets the parameter to a small value for a candidate voice segment sequence, among the plurality of generated candidate voice segment sequences, which is different from the time sequence which is assumed to be the input language information sequence, and calculates the degree of match between the input language information sequence and the candidate voice segment sequence by using at least one of the values. Therefore, the calculated degree of match is increased when the candidate voice segment sequence is the same as the DB voice segment sequence. As an alternative, the calculated degree of match is decreased when the candidate voice segment sequence differs from the DB voice segment sequence. As an alternative, the calculated degree of match is increased when the candidate voice segment sequence is the same as the DB voice segment sequence while the calculated degree of match is decreased when the candidate voice segment sequence differs from the DB voice segment sequence. As a result, the voice synthesizer can provide an advantage of being able to acquire an output voice segment sequence having a time sequence of sound parameters similar to a time sequence of sound parameters of a DB voice segment sequence which is constructed based on a narrator's recorded voice, and acquire a voice waveform close to the narrator's recorded voice.

Embodiment 3

In the method of setting the parameter 107 in accordance with Embodiment 1 or Embodiment 2, the parameter 107 can be set as follows. More specifically, the parameter 107 is set to a larger value when in a candidate voice segment sequence 102 corresponding to a sequence of pieces of DB language information 302 of a DB voice segment sequence, the degree of importance in terms of auditory sense of the sound parameters 303 of a DB voice segment in the DB voice segment sequence is large and the degree of similarity between the linguistic environment 309 of the DB language information 302 and the linguistic environment 309 of the candidate voice segment in the candidate voice segment sequence 102 is large.

Next, a method of setting the parameter 107 in accordance with Embodiment 3 will be explained. A candidate voice segment sequence generator 1 assumes that a sequence of pieces of DB language information 302 in a voice segment database 4 is an input language information sequence 101, and generates a plurality of candidate voice segment sequences 102 corresponding to this input language information sequence 101. An output voice segment sequence determinator then determines a degree of importance $C_1$ of the sound parameters 303 of each DB voice segment in the DB voice segment sequence which is the input language information sequence 101. In this case, the degree of importance $C_1$ has a large value when the sound parameters 303 of the DB voice segment is important in terms of auditory sense (the degree of importance is large). Concretely, for example, the degree of importance $C_1$ is expressed by the amplitude of the spectrum. In this case, the degree of importance $C_1$ becomes large at a point where the amplitude of the spectrum is large (a vowel or the like which can be easily heard auditorily), whereas the degree of importance $C_1$ becomes small at a point where the amplitude of the spectrum is small (a consonant or the like which cannot be easily heard auditorily as compared with a vowel or the like). Further, concretely, for example, the degree of importance $C_1$ is defined as the reciprocal of a temporal change in spectrum 306 of the DB voice segment (a temporal change in spectrum at a point close to the left end of the sound pressure signal sequence). In this case, the degree of importance $C_1$ becomes large at a point where the continuity in the connection of waveform segments 304 is important (a point between vowels, etc.), whereas the degree of importance $C_1$ becomes small at a point where the continuity in the connection of waveform segments 304 is not important (a point between a vowel and a consonant, etc.) as compared with the former point.

Next, for each of pairs of the linguistic environment 309 of each input language information in the input language information sequence 101 and the linguistic environment 309 of each candidate voice segment in the candidate voice segment sequence 102, the output voice segment sequence determinator determines a degree of similarity $C_2$ between the linguistic environments 309 of both the voice segments. In this case, the degree of similarity $C_2$ between the linguistic environments 309 has a large value when the degree of similarity between the linguistic environment 309 of each input language information in the input language information sequence 101 and the linguistic environment 309 of each voice segment in the candidate voice segment sequence 102 is large. Concretely, for example, the degree of similarity $C_2$ between the linguistic environments 309 is 2 when the linguistic environment 309 of the input language information in the input language information sequence 101 matches that of the candidate voice segment in the candidate voice segment sequence, the degree of similarity $C_2$ is 1 when only the phoneme of the linguistic environment 309 of the input language information in the input language information sequence 101 matches that of the candidate voice segment in the candidate voice segment sequence, or is 0 when the linguistic environment 309 of the input language information in the input language information sequence 101 does not match that of the candidate voice segment in the candidate voice segment sequence at all.

Next, an initial value of the parameter 107 of each cooccurrence criterion 106 is set to the parameter 107 set in Embodiment 1 or Embodiment 2. Next, for each voice segment in the candidate voice segment sequence 102, the parameter 107 of each applicable cooccurrence criterion 106 is updated by using $C_1$ and $C_2$. Concretely, for each voice segment in the candidate voice segment sequence 102, the product of $C_1$ and $C_2$ is added to the parameter 107 of each applicable cooccurrence criterion 106. For each voice segment in each of all the candidate voice segment sequences 102, this product is added to the parameter 107.

As previously explained, in the voice synthesizer in accordance with Embodiment 3 the candidate voice segment sequence generator assumes that a time sequence of voice segments in the voice segment database is an input language information sequence, and generates a plurality of candidate voice segment sequences corresponding to the time sequence which is assumed to be the input language information sequence, and, when the degree of importance in terms of auditory sense of each voice segment, among the plurality of generated candidate voice segment sequences, in the time sequence assumed to be the input language information sequence is high, and the degree of similarity between a linguistic environment which includes a target voice segment in the candidate voice segment sequence and is a time sequence of a plurality of continuous voice segments, and a linguistic environment in the time sequence assumed to be the input language information sequence is high, the output voice segment sequence determinator calculates the degree of match between the input language information sequence and each of the candidate voice segment sequences by using the parameter which is increased to a larger value than the parameter in accordance with Embodiment 1 or Embodiment 2. Accordingly, because the parameter of a cooccurrence criterion important in terms of auditory sense has a larger value, and the parameter of a cooccurrence criterion which is applied to a DB voice segment in a similar linguistic environment has a larger value, there is provided an advantage of providing an output voice segment sequence which is a time sequence of sound parameters more similar to a time sequence of sound parameters of a DB voice segment sequence constructed based on a narrator's recorded voice by using sound parameters important in terms of auditory sense, and hence providing a voice waveform closer to the narrator's recorded voice, and another advantage of providing an output voice segment sequence which is a time sequence of sound parameters more similar to a time sequence of sound parameters of DB voice segments having a linguistic environment similar to the sequence of the phonemes and the sound heights of the pieces of input language information, and hence providing a voice waveform whose descriptions in language of phonemes and sound heights are easier to be caught.

Further, because the product of $C_1$ and $C_2$ is added to the parameter of each cooccurrence criterion which is applied to each candidate voice segment in each candidate voice segment sequence in above-mentioned Embodiment 3, there is provided an advantage of providing an output voice segment sequence which is a time sequence of sound parameters more similar to a time sequence of sound parameters of DB voice segments having a linguistic environment similar to the sequence of the phonemes and the sound heights of the pieces of input language information by using sound parameters important in terms of auditory sense, and hence providing a voice waveform whose descriptions in language of phonemes and sound heights are easier to be caught.

Variant 1 of Embodiment 3

Although the product of $C_1$ and $C_2$ is added to the parameter 107 of each cooccurrence criterion 106 which is applied to each voice segment in each candidate voice segment sequence 102 in above-mentioned Embodiment 3, only $C_1$ can be alternatively added to the parameter 107. In this case, because when the degree of importance of the sound parameters 303 of a DB voice segment in a DB voice segment sequence, among a plurality of candidate voice segment sequences 102 corresponding to a sequence of pieces of DB language information 302 of a DB voice segment sequence, is high, the parameter 107 is set to a larger value, the parameter 107 of a cooccurrence criterion 106 important in terms of auditory sense has a large value, and there is provided an advantage of providing an output voice segment sequence which is a time sequence of sound parameters 303 more similar to a time sequence of sound parameters 303 of a DB voice segment sequence constructed based on a narrator's recorded voice by using sound parameters 303 important in terms of auditory sense, and hence providing a voice waveform closer to the narrator's recorded voice.

Variant 2 of Embodiment 3

Further, although the product of $C_1$ and $C_2$ is added to the parameter 107 of each cooccurrence criterion 106 which is applied to each voice segment in each candidate voice segment sequence 102 in above-mentioned Embodiment 3, only $C_2$ can be alternatively added to the parameter 107. In this case, because when the degree of importance of the sound parameters 303 of a DB voice segment in a DB voice segment sequence, among a plurality of candidate voice segment sequences 102 corresponding to a sequence of pieces of DB language information 302 of a DB voice segment sequence, is high, the parameter 107 is set to a larger value, the parameter 107 of a cooccurrence criterion 106 applied to a DB voice segment in a similar linguistic environment 309 has a large value, and there is provided an advantage of providing an output voice segment sequence 103 which is a time sequence of sound parameters 303 more similar to a time sequence of sound parameters 303 of DB voice segments having a linguistic environment 309 similar to the sequence of the phonemes and the sound heights of the pieces of input language information, and hence providing a voice waveform whose descriptions in language of phonemes and sound heights are easier to be caught.

Embodiment 4

Although the parameter 107 is set to a value depending upon the preferability of the combination of the input language information sequence 101 and the sound parameters of each candidate voice segment sequence 102 in Embodiment 1, the parameter 107 can be alternatively set as follows. More specifically, a model parameter acquired on the basis of a conditional random field (CRF) in which a feature function having a fixed value other than zero when the input language information sequence 101 and the sound parameters 303 of a plurality of candidate voice segments in a candidate voice segment sequence 102 satisfy a cooccurrence criterion 106, and having a zero value otherwise is defined as the parameter value.

Because the conditional random field is known as disclosed by, for example, "Natural language processing series Introduction to machine learning for natural language processing" (edited by Manabu OKUMURA and written by Hiroya TAKAMURA, Corona Publishing, Chapter 5, pp. 153 to 158), a detailed explanation of the conditional random field will be omitted hereafter.

In this case, the conditional random field is defined by the following equations (1) to (3).

$$L(w) = \sum_{t} \log P(y^{(i,0)} \mid x^{(i)}) - C_1|w| - C_2|w|^2 \quad \text{Equation (1)}$$

$$P(y^{(i,0)} \mid x^{(i)}) = \frac{1}{Z^{(i)}(w)} \exp\left(\sum_{s=0}^{L^{(i,0)}} w \cdot \phi(x^{(i)}, y^{(i,0)}, s)\right) \quad \text{Equation (2)}$$

$$Z^{(i)}(w) = \sum_{j=0}^{N^{(i)}} \exp\left(\sum_{s=0}^{L^{(i,j)}} w \cdot \phi(x^{(i)}, y^{(i,j)}, s)\right) \quad \text{Equation (3)}$$

In the above equations, the vector w has a value which maximizes a criterion L (w) and is a model parameter. $x^{(i)}$ is the sequence of pieces of DB language information 302 of the i-th voice. $y^{(i,0)}$ is the DB voice segment sequence of the i-th voice. $L^{(i,0)}$ is the number of voice segments in the DB voice segment sequence of the i-th voice. $P(y^{(i,0)}|x^{(i)})$ is a probability model defined by the equation (2), and shows a probability (conditional probability) that $y^{(i,0)}$ occurs when $x^{(i)}$ is provided. s shows the time position of each voice segment in the sound element sequence. $N^{(i)}$ is the number of possible candidate voice segment sequences 102 corresponding to $x^{(i)}$. Each of the candidate voice segment sequences 102 is generated by assuming that $x^{(i)}$ is the input language information sequence 101 and carrying out the processes in steps ST1 to ST3 explained in Embodiment 1. $y^{(i,j)}$ is the voice segment sequence corresponding to $x^{(i)}$ in the j-th candidate voice segment sequence 102. $L^{(i,j)}$ is the number of candidate voice segments in $y^{(i,j)}$. $\phi(x, y, s)$ is a vector value having a feature function as an element. The feature function has a fixed value other than zero (1 in this example) when, for the voice segment at the time position s in the voice segment sequence y, the sequence x of pieces of DB language information and the voice segment sequence y satisfy a cooccurrence criterion 106, and has a zero value otherwise. The feature function which is the k-th element is shown by the following equation.

$$\phi_k(x^{(i)}, y^{(i,j)}, s) = \begin{cases} 1 & \text{when cooccurence criterion is satisfied} \\ 0 & \text{otherwise} \end{cases} \quad \text{Equation (4)}$$

$C_1$ and $C_2$ are values for adjusting the magnitude of the model parameter, and are determined while being adjusted experimentally.

In the case of a parameter dictionary 5 shown in FIG. 4, the feature function which is the first element of $\phi(x^{(i)}, y^{(i,j)}, s)$ is given by equation (5).

$$\phi_1(x^{(i)}, y^{(i,j)}, s) = \begin{cases} 1 & \text{when sound height of current input language information is } H \text{ and fundamental freqency of current voice segment is 7} \\ 0 & \text{otherwise} \end{cases} \quad \text{Equation (5)}$$

In this equation (5), "current input language information" in the cooccurrence criterion 106 is replaced by "DB language information at position s in $x^{(i)}$" and "current voice segment" in the cooccurrence criterion 106 is replaced by "candidate voice segment at time position s in $y^{(i,j)}$", and the cooccurrence criterion 106 is thus interpreted to mean that "the sound height of the DB language information at the time position s in $x^{(i)}$ is H and the fundamental frequency of the candidate voice segment at the time position s in $y^{(i,j)}$ is 7." The feature function given by the equation (5) is 1 when this cooccurrence criterion 106 is satisfied, and is 0 otherwise.

By using a conventional model parameter estimating method, such as a maximum grade method or a probability gradient method, the model parameter w which is determined in such a way as to maximize the above-mentioned L(w) is set as the parameter 107 of the parameter dictionary 5. By setting the parameter 107 this way, an optimal DB voice segment can be selected on the basis of the measure shown by the equation (1).

As previously explained, because in the voice synthesizer in accordance with Embodiment 4, the output voice segment sequence determinator calculates the degree of match between each of candidate voice segment sequences and an input language information sequence by using, instead of the parameter in accordance with Embodiment 1, a parameter which is acquired on the basis of a random field model using a feature function having a fixed value other than zero when a criterion for cooccurrence between the input language information sequence and sound parameters showing the attribute of each of a plurality of candidate voice segments in the candidate voice segment sequence is satisfied, and having a zero value otherwise, there is provided an advantage of being able to automatically set a parameter according to a criterion that the conditional probability is a maximum, and another advantage of being able to construct, in a short time, a device that can select a voice segment sequence by using a consistent measure of maximizing the conditional probability.

Embodiment 5

Although the parameter 107 is set according to the equations (1), (2), and (3) in above-mentioned Embodiment 4, the parameter 107 can be set by using, instead of the equation (3), the following equation (6). The equation (6) shows a second conditional random field. The equation (6) showing the second conditional random field is acquired by applying a method called BOOSTED MMI, which has been proposed for the field of voice recognition (refer to "BOOSTED MMI FOR MODEL AND FEATURE-SPACE DISCRIINATIVE TRAINING", Daniel Povey et al.), to a conditional random field, and further modifying this method for selection of a voice segment.

$$Z^{(i)}(w) = \sum_{j=0}^{N^{(i)}} \exp\left(\sum_{s=0}^{L^{(i,j)}} (w \cdot \phi(x^{(i)}, y^{(i,j)}, s) - \quad \text{Equation (6)}$$

-continued $$\sigma\psi_1(y^{(i,0)}, s)\psi_2(y^{(i,j)}, y^{(i,0)}, s))\Big)$$

In the above equation (6), $\psi_1(y^{(i,0)}, s)$ is a sound parameter importance function, and returns a large (the degree of importance is large) value when the sound parameters 303 of the DB voice segment at the time position s of $y^{(i,0)}$ is important in terms of auditory sense. This value is the degree of importance $C_1$ described in Embodiment 3.

$\psi_2(y^{(i,j)}, y^{(i,0)}, s)$ is a language information similarity function, and returns a large value when the linguistic environment 309 of the DB voice segment at the position s in $y^{(i,0)}$ is similar to the linguistic environment 309 of the candidate voice segment at the position s in $y^{(i,j)}$ corresponding to $x^{(i)}$ (the degree of similarity is large). This value increases with increase in the degree of similarity. This value is the degree of similarity $C_2$ between the linguistic environments 309 described in Embodiment 3.

When determining a parameter w which maximizes L(w) by using the equation (6) to which $-\sigma\psi_1(y^{(i,0)}, s)\psi_2(y^{(i,j)}, y^{(i,0)}, s)$ is added, the model parameter w is determined in such a way as to compensate for $-\sigma\psi(y^{(i,0)}, s)\psi_2(y^{(i,j)}, y^{(i,0)}, s)$ compared with the case of using the equation (3). As a result, the language information similarity function has a large value and the sound parameter importance function has a large value, the parameter w in the case in which a cooccurrence criterion 106 is satisfied has a large value compared with that in the case of using the equation (3).

By using the model parameter which is determined the above-mentioned way as the parameter 107, when the degree of importance of the sound parameter 303 is large in step ST4, a degree of match placing greater importance on the linguistic environment 309 can be determined.

Variant 1 of Embodiment 5

Although the parameter w which maximizes L(w) is determined by using the equation (6) to which $-\sigma\psi_1(y^{(i,0)}, s)\psi_2(y^{(i,j)}, y^{(i,0)}, s)$ is added in the above-mentioned example, a parameter w which maximizes the equation (6) in which the above-mentioned additional term is replaced by $-\sigma\psi_2(y^{(i,j)}, y^{(i,0)}, s)$ can be alternatively determined. In this case, a degree of match placing further importance on the linguistic environment 309 can be determined in step ST4.

Variant 2 of Embodiment 5

Although the parameter w which maximizes L(w) is determined by using the equation (6) to which $-\sigma\psi(y^{(i,0)}, s)\psi_2(y^{(i,j)}, y^{(i,0)}, s)$ is added in the above-mentioned example, a parameter w which maximizes the equation (6) in which the above-mentioned additional term is replaced by $-\sigma\omega_1(y^{(i,0)}, s)$ can be alternatively determined. In this case, a degree of match placing further importance on the degree of importance of the sound parameters 303 can be determined in step ST4.

Variant 3 of Embodiment 5

Although the parameter w which maximizes L(w) is determined by using the equation (6) to which $-\sigma\psi_1(y^{(i,0)}, s)\psi_2(y^{(i,j)}, y^{(i,0)}, s)$ is added in the above-mentioned example, a parameter w which maximizes the equation (6) in which the above-mentioned additional term is replaced by $-\sigma_1\psi_1(y^{(i,0)}, s)-\sigma_2\psi_2(y^{(i,j)}, y^{(i,0)}, s)$ can be alternatively determined. $\sigma_1$ and $\sigma_2$ are constants which are adjusted experimentally. In this case, a degree of match placing further importance on both the degree of importance of the sound parameters 303 and the linguistic environment 309 can be determined in step ST4.

As previously explained, the voice synthesizer in accordance with Embodiment 5 simultaneously provides the same advantage as that provided by Embodiment 3, and the same advantage as that provided by Embodiment 4. More specifically, the voice synthesizer in accordance with Embodiment 5 provides an advantage of being able to automatically set a parameter according to a criterion that the second conditional probability is a maximum, another advantage of being able to construct, in a short time, a device that can select a voice segment sequence by using a consistent measure of maximizing the second conditional probability, and a further advantage of being able to acquire a voice waveform which is easy to be caught in terms of auditory sense and whose descriptions in language of phonemes and sound heights are easy to be caught.

While the invention has been described in its preferred embodiments, it is to be understood that an arbitrary combination of two or more of the above-mentioned embodiments can be made, various changes can be made in an arbitrary component in accordance with any one of the above-mentioned embodiments, and an arbitrary component in accordance with any one of the above-mentioned embodiments can be omitted within the scope of the invention.

For example, the voice synthesizer in accordance with the present invention can be implemented on two or more computers on a network such as the Internet. Concretely, waveform segments can be, instead of being one component of the voice segment database as shown in Embodiment 1, one component of a waveform segment database disposed in a computer (server) having a large-sized storage unit. The server transmits waveform segments which are requested, via the network, by a computer (client) which is a user's terminal to the client. On the other hand, the client acquires waveform segments corresponding to an output voice segment sequence from the server. By constructing the voice synthesizer this way, the present invention can be implemented even in computers having a small storage unit, and the same advantages can be provided.

What is claimed is:

1. A voice synthesizer comprising:

a candidate voice segment sequence generator that generates candidate voice segment sequences for an inputted language information sequence which is an inputted time sequence of voice segments by referring to a voice segment database that stores time sequences of voice segments;

an output voice segment sequence determinator that calculates a degree of match between each of said candidate voice segment sequences and said inputted language information sequence by using a parameter showing a value according to a criterion for cooccurrence between said inputted language information sequence and a sound parameter showing an attribute of each of a plurality of candidate voice segments in said candidate voice segment sequence to determine an output voice segment sequence according to said degree of match; and a waveform segment connector that connects between said voice segments corresponding to said output voice segment sequence to generate a voice waveform.

2. The voice synthesizer according to claim 1, wherein said output voice segment sequence determinator assumes that a time sequence of voice segments in said voice segment database is said inputted language information sequence to generate a plurality of candidate voice segment sequences corresponding to said time sequence assumed to be said inputted language information sequence, and calculates the degree of match by using said parameter which is increased when said each of said candidate voice segment sequences is same as said time sequence assumed to be said inputted language information sequence or calculates the degree of match by using said parameter which is decreased when said each of said candidate voice segment sequences is different from said time sequence assumed to be said inputted language information sequence.

3. The voice synthesizer according to claim 1, wherein said output voice segment sequence determinator assumes that a time sequence of voice segments in said voice segment database is said inputted language information sequence to generate a plurality of candidate voice segment sequences corresponding to said time sequence assumed to be said inputted language information sequence, and, when a value showing a degree of importance in terms of auditory sense of each voice segment, among said plurality of generated candidate voice segment sequences, in said time sequence assumed to be said inputted language information sequence is large, and a degree of similarity between a linguistic environment which includes a target voice segment in said candidate voice segment sequence and is a time sequence of a plurality of continuous voice segments, and said linguistic environment in said time sequence assumed to be said inputted language information sequence is large, calculates the degree of match by using a parameter which is increased to a larger value than said parameter.

4. The voice synthesizer according to claim 2, wherein said output voice segment sequence determinator assumes that a time sequence of voice segments in said voice segment database is said inputted language information sequence to generate a plurality of candidate voice segment sequences corresponding to said time sequence assumed to be said inputted language information sequence, and, when a value showing a degree of importance in terms of auditory sense of each voice segment, among said plurality of generated candidate voice segment sequences, in said time sequence assumed to be said inputted language information sequence is large, and a degree of similarity between a linguistic environment which includes a target voice segment in said candidate voice segment sequence and is a time sequence of a plurality of continuous voice segments, and said linguistic environment in said time sequence assumed to be said inputted language information sequence is large, calculates the degree of match by using a parameter which is increased to a larger value than said parameter.

5. The voice synthesizer according to claim 1, wherein said output voice segment sequence determinator calculates the degree of match between each of said candidate voice segment sequences and said inputted language information sequence by using, instead of said parameter, a parameter which is acquired on a basis of a random field model using a feature function having a fixed value other than zero when a criterion for cooccurrence between said inputted language information sequence and the sound parameter showing the attribute of each of the plurality of candidate voice segments in said each of said candidate voice segment sequences is satisfied, and having a zero value otherwise.

6. The voice synthesizer according to claim 1, wherein the cooccurrence criterion is one that a result of computation of a value of the sound parameter of each of the plurality of candidate voice segments in said each of said candidate voice segment sequences has a specific value.

* * * * *